United States Patent [19]

Shannon

[11] Patent Number: 5,044,600

[45] Date of Patent: Sep. 3, 1991

[54] ICE CUBE DISPENSER

[76] Inventor: Steven L. Shannon, Rte. 2, Box 103, Hiawatha, 66434

[21] Appl. No.: 645,147

[22] Filed: Jan. 24, 1991

[51] Int. Cl.[5] ..... B28B 7/24

[52] U.S. Cl. ..... 249/121; 249/69; 249/120; 249/127; 249/205; 221/91

[58] Field of Search ..... 221/28, 64, 69, 89, 221/91; 249/120, 121, 127, 69, 205; 425/440

[56] References Cited

U.S. PATENT DOCUMENTS

| | | | |
|---|---|---|---|
| 1,691,481 | 11/1928 | Jacques et al. | 249/121 |
| 2,049,902 | 8/1936 | Fischer | 249/121 |
| 2,503,693 | 4/1950 | Van Lennep | 249/121 |
| 3,159,985 | 12/1964 | Keighley | 249/127 X |
| 3,776,504 | 12/1973 | Wiley | 249/121 |
| 4,635,817 | 1/1987 | Kostov | 221/89 |
| 4,967,995 | 11/1990 | Burgess | 249/121 X |

*Primary Examiner*—Robert P. Olszewski
*Assistant Examiner*—Dean A. Reichard
*Attorney, Agent, or Firm*—Norman B. Rainer

[57] ABSTRACT

A device is provided to facilitate the dispensing of ice cubes from a flexible plastic ice cube tray having long edge lips. The device, of monolithic construction, has a small chamber for receiving and dispensing ice cubes from separate rows of the ice cube tray, and an adjacent large chamber for receiving and dispensing ice cubes from the entire ice cube tray. The device is provided with engagement rails that slideably engage the large edge lips of the ice cube tray.

4 Claims, 2 Drawing Sheets

ICE CUBE DISPENSER

BACKGROUND OF THE INVENTION

1. Field of the Invention

This invention relates to ice cube trays, and more particularly concerns apparatus for controllably dispensing ice cubes from an ice cube tray.

2. Discussion of the Prior Art

Flexible plastic ice cube trays are in widespread use. Such trays are typically of monolithic construction, having a multiplicity of ice cube compartments in a rectangular array with intervening flexible divider portions. The dimensions of the tray are generally compatible with the size of freezer compartments of household refrigerators. Release of the ice cubes is achieved by bending or twisting the tray. The tray is usually inverted to cause the cubes to drop out, often resulting in some spilling of the ice cubes. If the cubes are merely broken free but allowed to remain in their respective compartments, it is difficult to remove the cubes due to their close conformity to the walls of the compartments. A large container is usually necessary to catch the falling cubes, as it is difficult to controllably remove a few individual cubes to place in a glass. Hand manipulation of the ice cubes is not usually desired, and is generally considered to be an unsanitary practice. Often it is desirable to release an entire tray of cubes into a pitcher. However, the pitcher usually has a receiving opening smaller than the length of the tray. In such circumstances, there is almost certain dropping of ice cubes or splashing of liquid from the pitcher.

Considerable force must generally be applied to flex the plastic tray due to the adhesion between the plastic and the ice and the hardness of the ice. Many individuals have insufficient strength to accomplish this task. In order to reduce the adhesion and allow easier release of cubes, the tray may be inverted and rinsed with warmer water. However, this practice increases the chance of ice cube loss. If a container is placed underneath the inverted tray during the warming process, cubes will fall into a wet container. The wet ice cubes will subsequently freeze together if placed back in the freezer.

It is accordingly an object of the present invention to provide apparatus for controllably dispensing ice from an ice cube tray.

It is another object of the present invention to provide a dispenser adapted to interact with a flexible plastic ice cube tray to provide controllable release of ice cubes.

It is a further object of the present invention to provide apparatus comprised of a dispenser of the aforesaid nature for operative association with a plastic ice cube tray whereby controlled release of ice from said tray is achieved.

It is still another object of the present invention to provide apparatus of the aforesaid nature having means for directing the release of cubes into a container having a narrow opening.

It is yet another object of the present invention to provide apparatus of the aforesaid nature which may be inverted under a faucet to facilitate the release of cubes without loss of cubes.

It is a still further object of the present invention to provide a dispenser of the aforesaid nature of durable construction and amenable to low cost manufacture.

SUMMARY OF THE INVENTION

The above and other beneficial objects and advantages are accomplished in accordance with the present invention by a dispenser specially adapted for use with a flexible plastic ice tray of substantially conventional construction having an array of upwardly opening compartments of substantially uniform size and shape, each of said compartments being adapted to receive liquid to be frozen to form separate pieces of ice, said tray having an upper extremity defined by a rectangular perimeter comprised of paired long edge lips and paired short edge lips.

The dispenser of this invention is of substantially box-like rectangular configuration bounded in part by two pairs of straight parallel corner edges, each pair in vertically spaced apart relationship defining upper and lower edges which in turn define the top and bottom extremities,. respectively, of the dispenser, said dispenser further comprising:

(1) first and second parallel side walls extending vertically between said upper and lower corner edges, and horizontally terminating in straight vertical borders that substantially define front and rear extremities of the dispenser, (2) a front end panel extending othogonally between said side walls, (3) a small chamber having a first opening for receiving ice and a second opening for discharging ice, and bounded in part by said front end panel, a top panel disposed within the plane of the top extremity, a portion of said second side wall, and a divider panel spaced rearwardly from said front end panel and parallel thereto, said first opening being downwardly directed, and said second opening emergent through said first side wall, (4) a large chamber contiguous to said small chamber, a first opening for receiving ice and a second opening for discharging ice, and bounded in part by said divider panel, portions of said side walls, and a bottom panel disposed within the plane of said bottom extremity, said first opening being upwardly directed, and said second opening emergent at said rear extremity, and (5) engagement means associated with each corner edge in facing juxtaposition and adapted to slidably engage the long edge lips of said tray.

The tray and dispenser may each be of monolithic construction, fabricated of thermoplastic resin by an injection molding process. Typical resins employed may be polyethylene, polypropylene, and equivalent resins which remain resilient at low temperature and do not adversely affect water quality. The dispenser may be of resilent construction, enabling it to be flexed while positioned upon a plastic ice cube tray. A preferred type of tray for use with the dispenser of this invention is one whose long edge lips are provided with a thickened portion constituting a flange of uniform cross-sectional configuration.

The small chamber of the dispenser is preferably of a size and shape to permit the controlled release and discharge of a single lateral row of ice cubes from the tray, said lateral row being in parallel disposition to the short edge lips of the tray. The large chamber is adapted to permit the release of substantially all ice cubes from the tray.

In some embodiments, the dispener may have deflection means for directing the ice dischaged from the openings of the dispenser.

The dispenser may also be employed with non-flexible ice cube trays of metal construction having lever-operated means for separating the ice cubes from the tray. In such use however, the ice cubes must be loosened from their adherance to the tray before emplacement of the dispenser.

BRIEF DESCRIPTION OF THE DRAWING

For a fuller understanding of the nature and objects of the invention, refernce should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
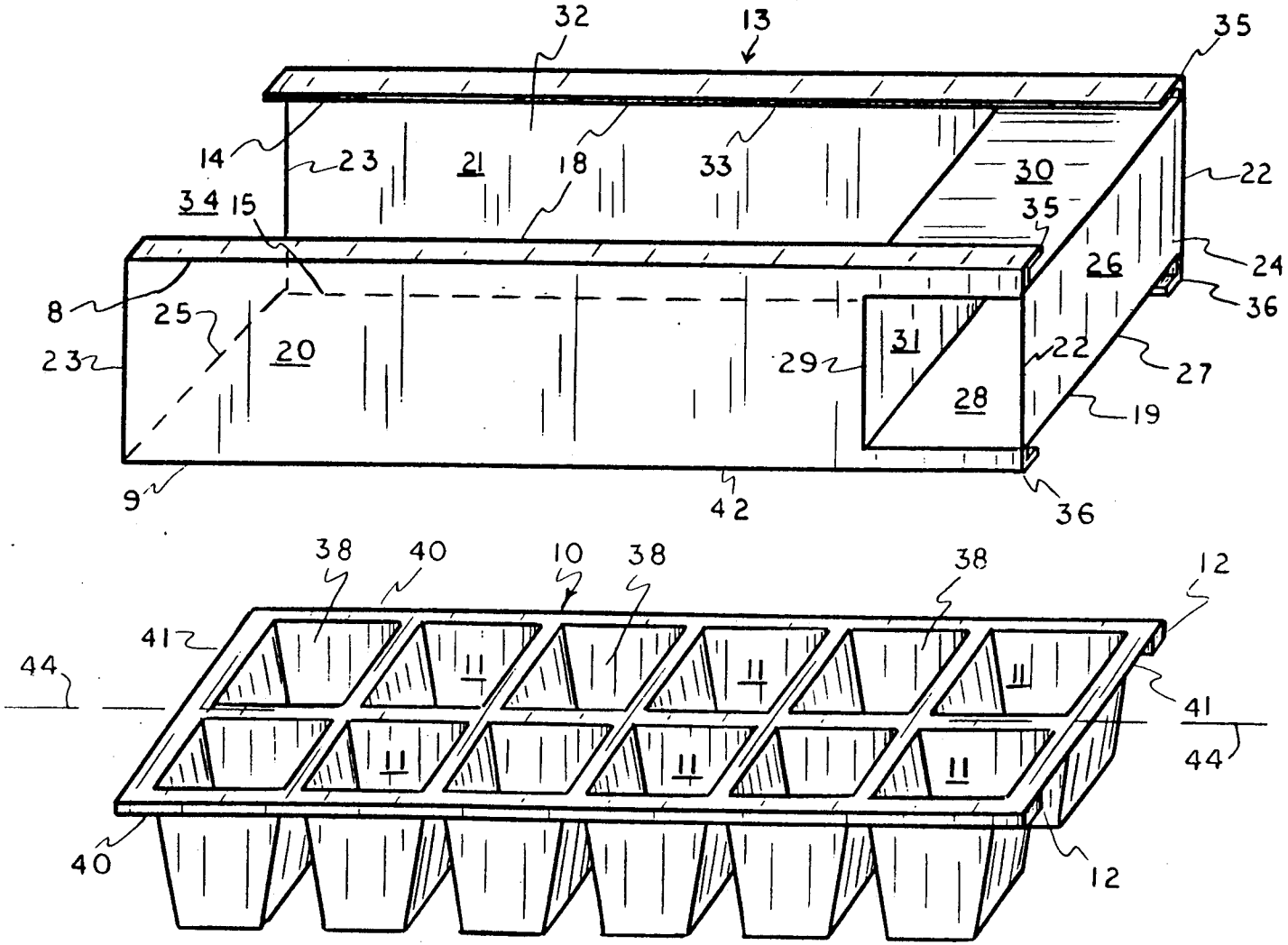
FIG. 1 is a perspective view of an embodiment of the dispenser of the present invention, shown positioned above a plastic ice cube tray.
Figure 2:
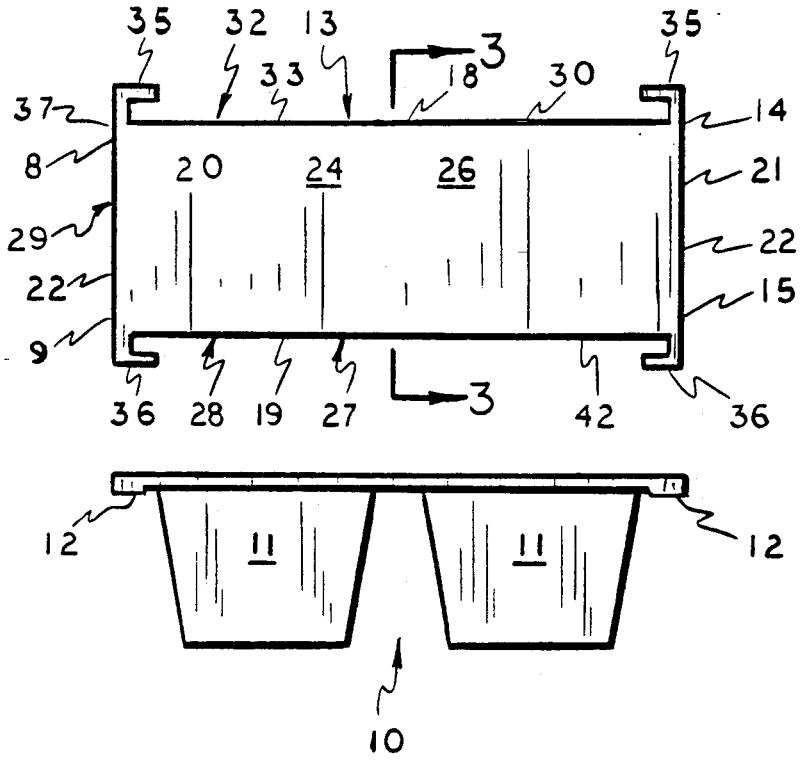
FIG. 2 is a front view of the embodiment of FIG. 1.
Figure 3:
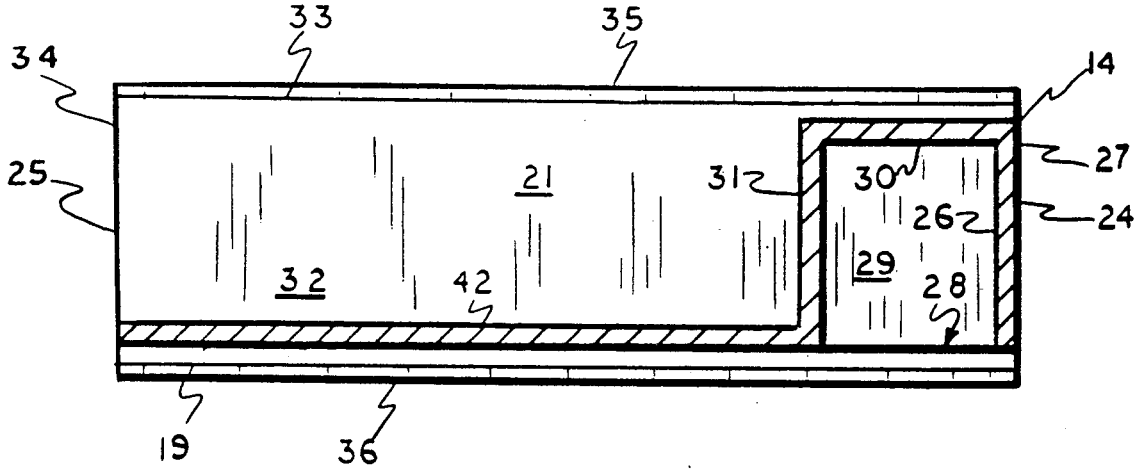
FIG. 3 is a sectional view taken upon the line 3—3 of FIG. 2.

Referring to FIGS. 1-3, an embodiment of the dispenser 13 of the present invention is shown in spaced apart association with an ice cube tray 10 of rectangular configuration. Tray 10 is of monolithic construction, having an array of distinct upwardly opening compartments 11 of uniform size and shape arranged in a number of lateral rows 38 transversely disposed to a center axis of elongation 44. Each compartment 11 is adapted to receive and retain liquid therein to be frozen to form separate pieces of ice. Tray 10 has an upper extremity of rectangular perimeter comprised of paired long edge lips 40 and paired short edge lips 41. In the exemplified embodiment, each of said long edge lips has a thickened zone 12 which functions as a flange. The long edge lips may be continuous or segmented.

Dispenser 13 is of substantially box-like rectangular configuration, bounded in part by two pairs of straight parallel elongated corner edges 14 and 15, and 8 and 9, respectively. Each pair is in vertically spaced apart relationship, defining edges 8 and 14 as upper edges, and edges 9 and 15 as lower edges. The plane in which edges 8 and 14 are disposed is considered the top extremity 18 of dispenser 13. The plane in which edges 9 and 15 are disposed is considered the bottom extremity 19 of dispenser 13. First and second parallel side walls 20 and 21, respectively, extend vertically between said upper and lower corner edges, and horizontally terminate in straight vertical borders 22 and 23. Vertical borders 22 and 23 define front and rear extremities 24 and 25, respectively, of dispenser 13. Front end panel 26 extends othogonally between side walls 20 and 21 and vertical borders 22. Dispenser 13 and tray 10 are each of monolithic construction, fabricated of thermoplastic resin such as polyethylene plastic, and formed by an injection molding process.

Small chamber 27 has first opening 28 for receiving ice and second opening 29 for discharging ice. Chamber 27 is bounded in part by front end panel 26, top panel 30 disposed within the plane of top extremity 18, a portion of side wall 21, and divider panel 31 horizontally spaced rearwardly from front end panel 26. First opening 28 is downwardly directed, and second opening 29 is emergent through first side wall 20. A deflection panel may be employed to direct ice exiting second opening 29. When employed, such deflection panel will extend at a downward angle away from the dispenser as a continuous integral extension of top panel 30.

Large chamber 32 is contiguous with small chamber 27, the chambers being separated by divider panel 31. Chamber 32 has first opening 33 for receiving ice and second opening 34 for discharging ice. Chamber 32 is bounded in part by divider panel 31, portions of side walls 20 and 21, and bottom panel 42 disposed within the plane of bottom extremity 19. First opening 33 is upwardly directed, and second opening 34 is emergent at rear extremity 25.

Bottom engagement means in the form of rails 36 extend beneath bottom extremity 19 and are associated with bottom corner edges 15 and 9 in facing juxtaposition and adapted to slidably engage flanges 12 of the tray. Top engagement means in the form of rails 35 overly top extremity 18 and are associated with each top corner edge 14 and 8 in facing juxtaposition and adapted to slidably engage the flanges of the tray when dispenser 13 is in an inverted disposition.

Release of ice from a single lateral row 38 is effected by flexing or twisting tray 10 and dispenser 13 whose bottom rails 36 engage flanges 12. Alternatively, the engaged tray may be inverted and subjected to a stream of warm water from a faucet. Once the ice cubes have been broken free from adhesion to the compartments 11, they will enter chamber 27 through opening 28. The apparatus is then tilted to allow the ice cubes to discharge through opening 29 and be directed into a glass or other drinking vessel. Dispenser 13 is then slid horizontally with respect to tray 10 until chamber 27 is aligned with the next adjacent lateral row 38, and the process is repeated.

Release of substantially all of the ice cubes in tray 10 simultaneously is effected by flexing the dispenser while top engagement rails 35 engage the flanges of the tray. The cubes may be released by flexing, twisting or inversion beneath a stream of warm water. Once dislodged, the cubes enter chamber 32 through opening 33, and may be discharged through opening 34 into a pitcher or other suitable container by tilting the rear extremity of the apparatus downwardly. Any remaining ice cubes in the tray may by discharged by sliding dispenser 13 relative to tray 10 until chamber 32 is aligned with lateral rows 38 still containing ice cubes.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A dispenser specially adapted for use with a flexible plastic ice tray of substantially conventional construction having an array of upwardly opening compartments of substantially uniform size and shape arranged in a number of rows transversely disposed to a center axis of elongation, each of said compartments being adapted to receive liquid to be frozen to form separate pieces of ice, said tray having an upper extremity defined by a rectangular perimeter comprised of paired long edge lips and paired short edge lips, said dispenser being of substantially box-like rectangular configuration bounded in part by two pairs of straight parallel corner edges, each pair in vertically spaced apart relationship defining upper and lower edges which in turn define the top and bottom extremities, respectively, of the dispenser, said dispenser further comprising:

(a) first and second parallel side walls extending vertically between said upper and lower corner edges, and horizontally terminating in straight vertical borders that substantially define front and rear extremities of the dispenser, (b) a front end panel extending othogonally between said side walls, (c) a small chamber having a first opening for receiving ice and a second opening for discharging ice, and bounded in part by said front end panel, a top panel disposed within the plane of the top extremity, a portion of said second side wall, and a divider panel spaced rearwardly from said front end panel and parallel thereto, said first opening being downwardly directed, and said second opening emergent through said first side wall, (d) a large chamber contiguous to said small chamber, having a first opening for receiving ice and a second opening for discharging ice, and bounded in part by said divider panel, portions of said side walls, and a bottom panel disposed within the plane of said bottom extremity, said first opening being upwardly directed, and said second opening emergent at said rear extremity, and (e) engagement means associated with each corner edge in facing juxtaposition and adapted to slidably engage the long edge lips of said tray.

2. The dispenser of claim 1 of monolithic construction, fabricated of a thermoplastic resin.

3. The dispenser of claim 1 wherein the size and shape of said small chamber is such as to permit the controlled release and discharge of a single row of ice cubes from the tray.

4. Apparatus for producing ice cubes comprising the dispenser of claim 1 in combination with a flexible plastic ice cube tray of monolithic construction having an array of upwardly opening compartments of substantially uniform size and shape arranged in a number of rows transversely disposed to a center axis of elongation, each of said compartments adapted to receive liquid to be frozen to form separate pieces of ice, said tray having an upper extremity defined by a rectangular perimeter comprised of paired long edge lips and paired short edge lips.

* * * * *